US005167214A

United States Patent [19]

deRonde

[11] Patent Number: 5,167,214

[45] Date of Patent: Dec. 1, 1992

[54] PUSH ROD-ACTUATED ENGINE IGNITION APPARATUS

[75] Inventor: Frederik L. A. deRonde, Covina, Calif.

[73] Assignee: Pertronix, Inc., Covina, Calif.

[21] Appl. No.: 684,000

[22] Filed: Apr. 11, 1991

[51] Int. Cl.[5] ..... F02P 9/00

[52] U.S. Cl. ..... 123/617; 123/414

[58] Field of Search ..... 123/617, 414, 406

[56] References Cited

U.S. PATENT DOCUMENTS

| | | | |
|---|---|---|---|
| 808,554 | 12/1905 | Le Pontois | 123/617 |
| 3,156,227 | 10/1964 | Hufferd | 123/617 |
| 3,906,920 | 9/1975 | Hemphill . | |
| 4,235,213 | 11/1980 | Jellissen . | |
| 4,275,703 | 6/1981 | Bodig | 123/617 |
| 4,284,916 | 8/1981 | Onodera | 123/617 |
| 4,428,332 | 1/1984 | Brammer | 123/617 |
| 4,491,121 | 1/1985 | Miura et al. . | |
| 4,508,092 | 4/1985 | Kiess et al. . | |
| 4,570,118 | 2/1986 | Tomczak | 123/617 |
| 4,887,572 | 12/1984 | Kodama | 123/617 |
| 5,014,005 | 5/1991 | Murata | 123/617 |

*Primary Examiner*—Carl S. Miller

*Attorney, Agent, or Firm*—Sheldon & Mak

[57] ABSTRACT

A solid-state, push rod actuated breakerless ignition system is disclosed that is particularly suitable for use as original equipment or an after market upgrade for many industrial engines of the type having a cam-operated push rod actuated ignition. The apparatus includes a base for mounting to the engine, a rocker arm movably mounted to the base for periodic actuation by the cam lobe and having a first transducer element fixably located thereon for movement in an arm path, a second transducer element mounted in predetermined relation to the base proximate the arm path, and a circuit for producing an electrical trigger signal in response to the movement of the first transducer element to a predetermined spatial relation with the second transducer element, the combustion being initiated in response to the trigger signal.

17 Claims, 1 Drawing Sheet

PUSH ROD-ACTUATED ENGINE IGNITION APPARATUS

BACKGROUND

The present invention relates to internal combustion engines, and more particularly to engines of the type having a cam lobe, rather than a conventional distributor shaft, for operating an ignition system of the engine.

Ignition systems for the majority of internal combustion engines include a distributor unit having a rotatably mounted distributor shaft that is geared to a crank shaft of the engine, the distributor shaft extending from a distributor housing and having a rotor in the housing for sequentially defining a high-voltage electrical path to each spark plug of the engine. Traditionally, a set of electrical breaker points that are operated by a cam on the distributor shaft within the housing periodically interrupt a low-voltage primary circuit for properly timing activation of the high-voltage electrical circuitry. Typically, the points are provided in an assembly having a radial adjustment for defining a point gap and corresponding duty cycle or dwell angle of the primary circuit. The breaker point assembly is also mounted on a breaker plate having vacuum-actuated rotational movement for defining a variable vacuum advance. Similarly, the cam for actuating the breaker points is rotatably mounted on the distributor shaft and controlled relative thereto by a centrifugal advance mechanism. Thus dynamic ignition timing is variably responsive to manifold vacuum and the rotational speed of the engine, overall adjustment of the ignition timing being further effected by rotational adjustment of the distributor housing relative to the crank case or other stationary structure of the engine.

A relatively recent development is the substitution of magnetically activated solid-state circuitry for the breaker points. See, for example, U.S. Pat. No. 3,906,920 to Hemphill.

In another class of conventional internal combustion engines typically used in stationary power plants and mobile refrigeration units, the engine is operated at nearly constant speed and loading. Consequently, the vacuum and centrifugal advance mechanisms are usually omitted in order to save manufacturing and maintenance costs. In one variation of this class, a magnet or other trigger device is fixably mounted to the crankshaft or flywheel of the engine, and a magnetic pick-up coil or other sensor is mounted to the crank case or other fixed location. A problem with this configuration is that maintenance is difficult, particularly when the moving parts of the engine are completely enclosed. In such cases, the crankcase must be dismantled in order to perform routine maintenance, resulting in unwanted expense and delay. Moreover, the timing of the ignition is difficult to adjust because of the same limited accessibility. In another variation of this class, conventional breaker points are used, the breaker points being operated by a push rod that is actuated from within the crank case by a rotating cam member. Although push rod actuated ignition systems for such applications are inexpensive to produce because the conventional distributor housing shaft is not used, they are subject to the limitations and disadvantages that are associated with conventional breaker points. For example, the breaker points are subject to mechanical wear and arc-induced erosion, particularly when the points directly interrupt the primary circuit current of the ignition. This problem is exacerbated by the limited availability of replacement parts for special purpose engines. Further, the use of solid-state circuitry for permitting "dry-circuit" operation of the breaker points is undesirably expensive in that there is typically no convenient location for inexpensively mounting such circuitry because the breaker points themselves occupy a relatively large proportion of the available space. Moreover, even with such solid-state circuitry, the mechanical wear of the breaker point assembly is not eliminated.

Modern solid-state ignition technology of the prior art has not been applied to eliminate the breaker point assembly from push rod actuated ignition systems. This is because the modern solid-state systems each require a rotating member for repetitively producing or interrupting a magnetic field or other form of radiation.

Thus there is a need for a push rod actuated ignition system that completely eliminates the use of breaker points, that provides conveniently adjustable ignition timing, that is reliable and inexpensive to maintain.

SUMMARY

The present invention meets this need by providing a solid-state, push rod actuated breakerless ignition system that is particularly suitable for use as original equipment or an after market upgrade for many industrial engines of the type having a cam-operated push rod actuated ignition. The apparatus includes a base for mounting to the engine, a rocker arm movably mounted to the base for periodic actuation by the cam lobe and having a first transducer element fixably located thereon for movement in an arm path, a second transducer element mounted in predetermined relation to the base proximate the arm path, circuit means for producing an electrical trigger signal in response to the movement of the first transducer element to a predetermined spatial relation with the second transducer element, and means for initiating the combustion in response to the trigger signal.

The rocker arm can be pivotably mounted on an arm axis, and means for biasing the rocker arm against movement of the cam lobe can be included. Preferably the second transducer element is movably mounted to the base on a transducer platform for adjustment of ignition timing. The transducer platform can be pivotally movable about the arm axis. The apparatus can include an adjustment screw threadingly engaging one of the base and the transducer platform, and an adjustment spring for biasing the transducer platform in opposition to the adjustment screw, whereby tightening and loosening of the adjustment screw produces bidirectional movement of the transducer platform relative to the base. Preferably the apparatus includes clamp means for rigidly clamping the transducer platform against the base for selectively preventing the movement of the transducer platform. The clamp means, which can include a lock nut on a threaded stud that protrudes a guide slot of the transducer platform, advantageously stabilizes a spacing between the transducer elements.

The second transducer element can include a radiation detector, the apparatus further including means for producing radiation from the first transducer element, the second transducer element being responsive to the radiation from the first transducer element. The first transducer element can include a source of the radiation, being a magnetic member in a preferred configuration for producing a magnetic field. The second transducer element can include a Hall-effect sensor for producing the trigger signal at a predetermined magnetic field intensity.

The trigger signal can be activated during a first direction of movement of the first transducer element relative to the second transducer element, and the trigger signal can reset during an opposite second direction of movement of the first transducer element relative to the second transducer element. Preferably, the trigger signal is reset only during the second direction of movement of the first transducer element. The second transducer element can be fixedly mounted relative to a transducer platform, and the circuit means includes a solid-state switching device for activating an ignition coil in response to the second transducer element, the switching device being mounted to the transducer platform for dissipation of heat from the device to the platform.

DRAWINGS

These and other features, aspects, and advantages of the present invention will become better understood with reference to the following description, appended claims, and accompanying drawings where:

DESCRIPTION

Figure 1:
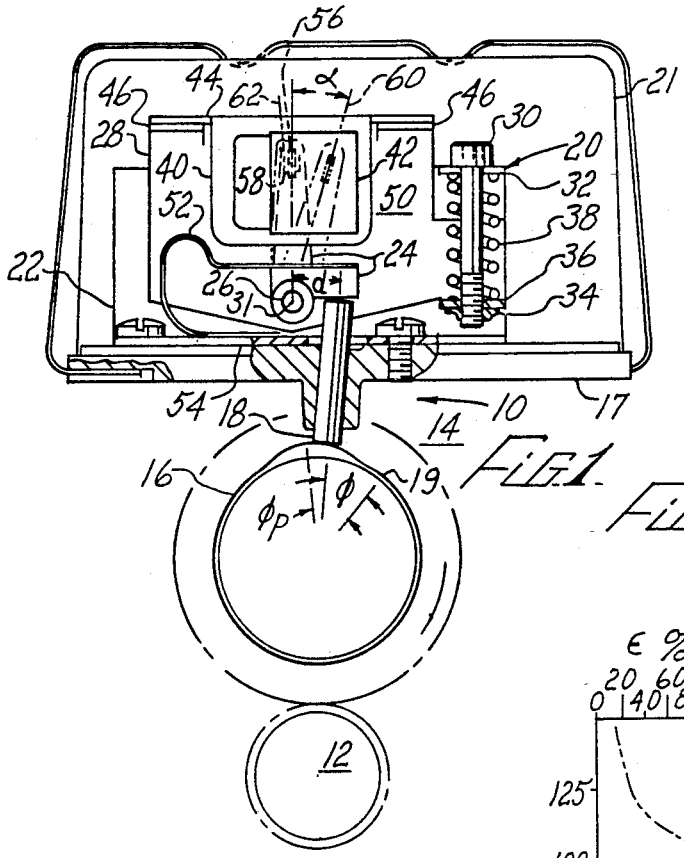
FIG. 1 is a fragmentary sectional front elevational view of an ignition system module according to the present invention, the module being installed on an internal combustion engine.
Figure 2:
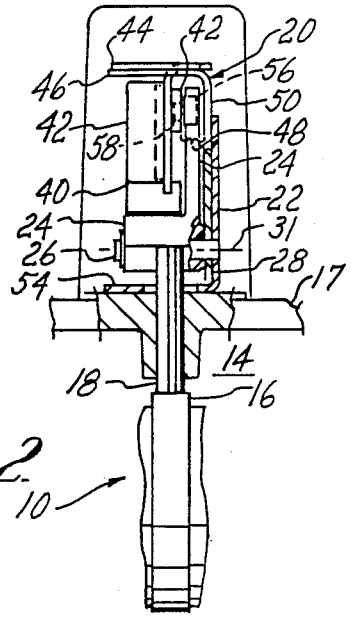
FIG. 2 is a fragmentary sectional side elevational view of the module and engine of FIG. 1.

The present invention is directed to an ignition system for an internal combustion engine having a rotating cam lobe for actuating a push rod, but not having a conventional distributor shaft. With reference to the drawings, an internal combustion engine 10 having a crank shaft 12 rotatably mounted within a crank case 14 includes a cam member 16 that also rotates in the crank case 14 correspondingly with the crank shaft 12. It will be understood that the cam member 16 can be either fixed relative to the crank shaft 12 or geared relative thereto in a conventional manner as shown schematically in FIG. 1. A plate member 17 that forms a portion of the crank case 14 axially slidably holds a push rod 18, the push rod 18 being periodically actuated by the cam member 16 at a frequency proportional to the speed of rotation of the crank shaft 12. As shown in FIG. 1, the rotational position of the cam member 16 is depicted by a cam angle $\phi$ between a base circle extremity 19 of the cam member 16 and the point of contact between the push rod 18 and the cam member 16.

An ignition unit 20 according to the present invention includes a base member 22 for mounting in fixed relation to the plate member 17 of the crank case 14. An arm member 24 is pivotally mounted to the base member 22 by a post or arm rivet 26 for actuation by the push rod 18. A module plate 28 is also pivotally mounted relative to the base member 22 by the rivet 26, the module plate 28 being adjustably angularly oriented relative to the base member 22 by a timing screw 30. Thus the arm member 24 and the module plate 28 are each rotatable about an arm axis 31 of the rivet 26. The timing screw 30 protrudes a base tab member 32 of the base member 22 and threadingly engages a rectangular nut plate 34, the nut plate 34 being fixably retained against a nut tab member 36 of the module plate 28 that is also protruded by the timing screw 30, the timing screw 30 being moderately loaded by a helical compression timing spring 38 that is interposed between the base tab member 32 and nut tab member 36. The nut plate 24 can be prevented from rotating during adjustment of the timing screw 30 by any conventional means.

A trigger module 40 having a body portion 42 and a flange portion 44 is fixably mounted to a mounting flange portion 46 of the module plate 28, such that a slot 48 is formed between the body portion 42 and a main portion 50 of the module plate 28. The arm member 24 swings in close proximity to the body portion 42 within the slot 48. The arm member 24 is rotationally biased against the push rod 18 and the cam member 16 by a leaf spring 52, one end of the spring 52 being fixably mounted to the arm member 24, an opposite end of the spring 52 being supported by a base portion 54 of the base member 22. Thus the arm member 24 swings in a first direction as the cam member 16 rises against the push rod 18, the leaf spring 52 being correspondingly deflected. Further rotation of the cam member 16 past the push rod 18 produces a falling movement of the cam member 16 relative to the push rod 18, the push rod 18 being maintained in contact with the cam member 16 by pressure from the arm member 24 that is produced by the leaf spring 52, the arm member 24 moving in a second, opposite direction. Thus the arm member 24 oscillates within the slot 48 in direct correspondence with a profile of the cam member 16.

According to the present invention, a small permanent magnet 56 is fixably mounted proximate an extremity of the arm member 24 for producing a pattern of magnetic radiation, the magnet 56 swinging in close proximity to a Hall-effect sensor element 58 that is encapsulated within the trigger module 40, the element 58 being operatively responsive to magnetic flux variations associated with movement of the magnet 56, as further described herein. As also shown in FIG. 1, the arm member 24 oscillates between a base position 60 (corresponding to the push rod 18 engaging a base circle or like center portion of the cam member 16) and a peak position 62 (corresponding to the push rod 18 engaging the full lobe height of the cam member 16). The position of the arm member 24 as it moves relative to the base position 60 and the peak position 62 is represented by an arm angle $\alpha$.

Figure 3:
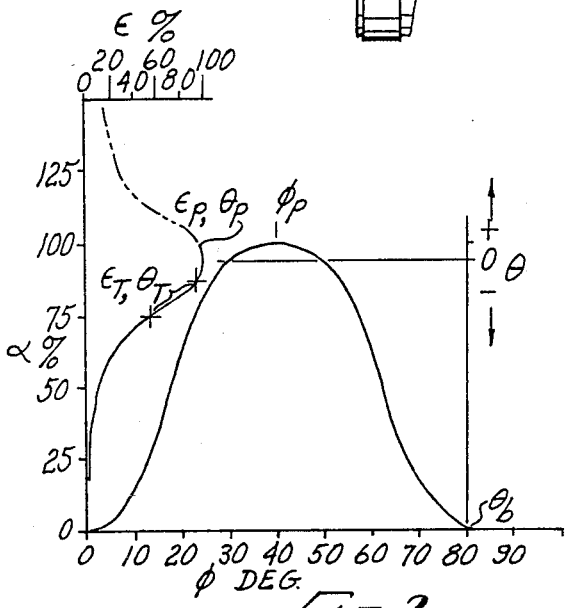
FIG. 3 is a simplified schematic diagram of the system of FIG. 1.

With further reference to FIG. 3, the relationship between the arm angle $\alpha$ and the cam angle $\phi$ reflects the profile of the cam member 16 and an offset distance d between the push rod 18 and the arm axis 31. The arm angle $\alpha$ is plotted as a percentage or the range between the base position 60 and the peak position 62, the cam member 16 causing the arm member 24 to so move as the angle $\phi$ increases from zero to an angle $\phi_P$ associated with full travel of the push rod 18. Arbitrarily, the angle $\phi_P$ is shown as being 40° in FIG. 3, Depending on the adjustment of the module plate 28 by the timing screw 30, the magnet 56 correspondingly moves at a variable magnet angle $\theta$ relative to the sensor element 58, between a base angle $\theta_B$ in the base position 60 and a peak angle $\theta_P$ in the fully actuated position 62 of the arm member 24. If the base angle $\theta_B$ is taken as negative, the peak angle $\theta_P$ is typically slightly positive. In other words, the magnet 56 normally swings slightly past direct alignment with the sensor element 58. The arm member 24, or that portion thereof proximate the magnet 56, is fabricated from a non-magnetically permeable material such as Nylon for avoiding distortion of the magnetic field associated with the magnet 56.

Figure 4:
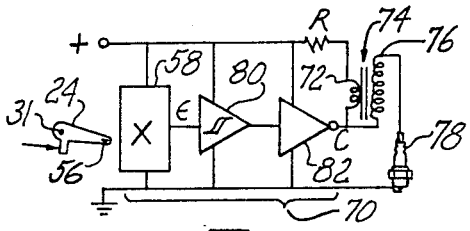
FIG. 4 is a graph showing operation of the system of FIG. 1.

With further reference to FIG. 4, the sensor element 58 is operatively connected in a trigger circuit 70 for pulsing a primary winding 72 of an ignition coil 74, a secondary winding 76 of the coil 74 being connected to a spark plug 78 of the engine 10 in a conventional manner. The trigger circuit 70 is arranged for interrupting current in the primary winding 72 when the magnet 56 reaches a predetermined position, at a trigger angle $\theta_T$ of the magnet 56 relative to the sensor element 58, but only during the first direction of movement of the arm member 24 (the rising profile portion of the cam member 16) the trigger circuit 70 being preferably reset during the second direction of movement of the arm member 24. Typically, the trigger angle $\theta_T$ at which the trigger circuit 70 is actuated is slightly negative (triggering occurs when the magnet 56 has moved almost into alignment with the sensor element 58). Accordingly, when the sensor element 58 is operative in a conventional unpolarized mode, the module plate 28 is adjusted by the timing screw 30 within a range of positions wherein the angle $\theta$ of the magnet 56 is not sufficiently positive to result in deactivation of the sensor element 58.

As further shown in FIG. 3, a sensor voltage $\epsilon$ from the Hall sensor element 58 is approximately a Gaussian function of the magnet angle $\theta$. The sensor voltage $\epsilon$ reaches a maximum (100%) when the magnet angle $\theta$ is zero. Accordingly, the trigger circuit 70 is triggered at a trigger voltage $\epsilon_T$ of the sensor element 58 that is produced at the trigger magnet angle $\theta_T$, a voltage $\epsilon_P$ being produced at the peak magnet angle $\theta_P$. Assuming that there is no hysterisis in the trigger circuit 70, the preferred resetting of the trigger circuit 70 only during the second direction of movement occurs when the trigger voltage $\epsilon_T$ is less than the voltage $\epsilon_P$. Also, the trigger angle $\theta_T$ is preferably within a high voltage gradient range of the voltage $\epsilon$, the voltage $\epsilon_T$ being shown in FIG. 3 as between just below $\epsilon_P$ and a point of inflection of the sensor voltage $\epsilon$.

As further shown in FIG. 4, the trigger circuit 70 includes a detector amplifier 80 that is responsive to the sensor element 58, the amplifier 80 driving a power switch 82 for intermittently powering a primary coil terminal C of the ignition coil 74 as described above. Preferably the detector amplifier provides hysterisis between its input and its output for avoiding false triggering and/or resetting of the trigger circuit 70. Further, the hysterisis of the detector amplifier 80 permits the trigger voltage $\epsilon_T$ to occur at a higher level of the voltage $\epsilon$, without false resetting during continued motion of the arm 24 in its first direction of travel. The hysterisis can be introduced by conventional means such as by positive feedback at low gain. A module suitable for use in the uni-polar mode as the trigger module 40 is available from PerLux, Inc. of Covina, Calif., assignee of the present invention. Alternatively, the sensor element 58 can be implemented for bipolar operation, a pair of the magnets 56, oppositely polarized, being mounted to the arm member 24 according to methods known to those skilled in the art.

Figure 5:
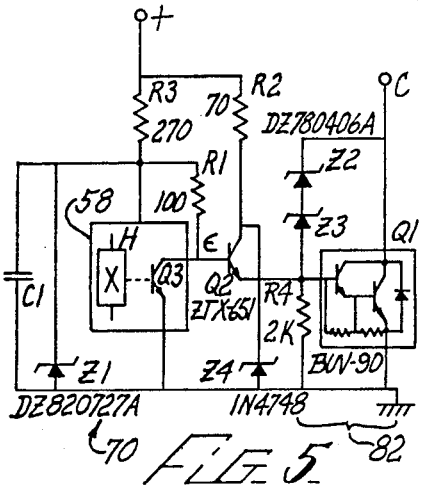
FIG. 5 is a circuit diagram showing ah exemplary circuit configuration of the module of FIG. 1.

With further reference to FIG. 5, a particular implementation of the trigger circuit 70 includes a shunt Zener regulator Z1 that is fed from ignition power (+) through a resistor R3 for supplying the Hall sensor element 58, the output of the sensor element 58 being connected through a sensor load resistor R1 to the regulator Z1 for positively biasing the sensor voltage $\epsilon$. The power switch 82 includes a power Darlington device Q1 having a series connected pair of Zener diodes Z2 and Z3 connected between its collector and base terminals for regeneratively clamping a maximum coil voltage at the coil terminal C. A counterpart of the detector amplifier is provided by a detector transistor Q2 having its collector powered through a resistor R2 and shunt regulated by a fourth Zener diode Z4, the transistor Q2 being connected as an emitter follower for driving the Darlington device Q1 and a load resistor R4 with a counterpart of the sensor voltage $\epsilon$. As further shown in FIG. 5, the sensor element 58 includes a Hall device H and a phototransistor Q3.

Figure 6:
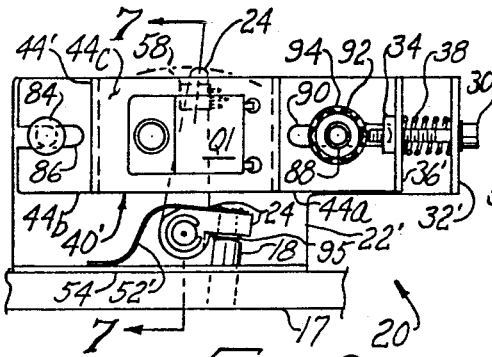
FIG. 6 is a front elevational view of an alternative configuration of the module of FIG. 1.
Figure 7:
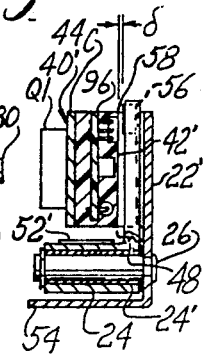
FIG. 7 is a side elevational view of the module of FIG. 6.

With further reference to FIGS. 6 and 7, an alternative configuration of the ignition unit 20 has a counterpart of the trigger module 40, designated 40', the module 40' being adjustably slidably mounted to a counterpart of the base member 22, designated base member 22'. The trigger module 40' includes a counterpart of the flange portion 44, designated flange member 44', and having a front flange portion 44*a*, a rear flange portion 44*b*, and a center flange portion 44*c*. The trigger module 40 is guided on the base member 22' by a flanged guide pin 84 that engages a first guide slot 86 that is formed in the rear flange portion 44*b*, and by a threaded stud 88 that engages a second guide slot 90 of the front flange portion 44*a*, the slots 86 and 90 being aligned parallel to the base portion 54 of the base member 22', the pin 84 and the stud 88 being riveted to the base member 22'. A combination star-lockwasher clamp nut 92 and a plain washer 94, that engage the threaded stud 88, clamps the flange member 44' to the base member 22'. Counterparts of the timing screw 30, the nut plate 34, and the timing spring 38 are oriented horizontally in line with the slots 86 and 90, the spring 38 being interposed between counterparts of the base tab member 32, designated 32' and the nut tab member 36, designated 36'.

An inverted counterpart of the leaf spring 52, designated 52', biases the arm member 24 against the push rod 18, the spring 52' being fastened to the arm member 24 by a spring rivet 95 that also provides a wear-resistant contact surface for the push rod 18. The arm rivet 26 is preferably formed of a conventional 400-series corrosion-resistant steel and having a hardened shank, the arm member 24 also being provided with a hardened tool steel bushing 24' for wear resistance.

As shown in FIG. 7, the center flange portion 44*c* is spaced from the base member 22', having the Darlington device Q1 mounted thereto, the flange member 44' being formed of an aluminum alloy for dissipation of heat from the device Q1. The remainder of the trigger circuit 70 is located between the center flange portion 44*c* and the base member 22' in a module portion 42'. The base member 22' is preferably formed of a material having high magnetic permeability such as cold-rolled steel for concentrating the magnetic field of the magnet 56 at the sensor element 58. Elements of the circuit 70 are connected on a printed circuit board 96 that is mounted in spaced relation to the center flange portion 44c by conventional means (not shown), the circuit board 96 also being molded within the module portion 42, using a suitable potting compound. For enhanced sensitivity to the magnet 56, the sensor element 58 is mounted for molding flush with the outside of the module portion 42', which also forms a boundary of the slot 48, the magnet 56 passing the sensor element 58 with a clearance gap δ that can be from about 0.030 inch to about 0.040 inch. For this purpose, and because others of the circuit elements are taller than the thickness of the sensor element 58, the element 58 is mounted by its leads in spaced relation to the circuit board 96. A suitable spacer block (not shown) can also be used for rigidly supporting the sensor element 58 at a desired distance from the circuit board 96 until the potting compound solidifies.

Although the present invention has been described in considerable detail with reference to certain preferred versions thereof, other versions are possible. For example, the leaf spring 52 can be supported against a portion of the module plate 28, rather than the spring tab portion 54 of the base member 22. Also, the capacitor Cl can be omitted from the trigger circuit 70. Further, other radiation sources can be substituted for the magnet 56, the sensor element 58 being provided as a photosensor. Thus the element 56 can be a source of photon radiation such as a radioactive element, a reflector or refractor of light from a stationary light emitter, etc. Therefore, the spirit and scope of the appended claims should not necessarily be limited to the description of the preferred versions contained herein.

What is claimed is:

1. An ignition apparatus for an internal combustion engine having a cam shaft lobe for actuating a push rod, but not having a distributor shaft rotatable for actuating breaker points or the like, the apparatus comprising:

(a) a base for mounting to the engine;

(b) a rocker arm movably mounted to the base for periodic actuation by the cam lobe and having a first transducer element fixably located thereon for movement in an arm path, the first transducer element comprising a magnetic member for producing a magnetic field;

(c) a second transducer element mounted in fixed relation to a transducer platform, the transducer platform being slidably mounted to the base proximate the arm path for adjustment of ignition timing, the second transducer element comprising a Hall-effect sensor;

(d) an adjustment screw threadingly engaging one of the base and the transducer platform, and an adjustment spring for biasing the transducer platform in opposition to the adjustment screw, whereby tightening and loosening of the adjustment screw produces bidirectional movement of the transducer platform relative to the base;

(e) clamp means for rigidly clamping the transducer platform against the base for selectively preventing the movement of the transducer platform;

(f) circuit means for producing an electrical trigger signal in response to the movement of the first transducer element to a predetermined spatial relation with the second transducer element; and (g) means for initiating the combustion in response to the trigger signal.

2. An ignition apparatus for an internal combustion engine having a crankshaft-operated cam shaft lobe for actuating a push rod, but not having a distributor shaft rotatable for actuating breaker points or the like, the apparatus comprising:

(a) a base for mounting to the engine;

(b) a rocker arm movably mounted to the base for periodic actuation by the cam lobe and having a first transducer element fixably located thereon for movement in an arm path;

(c) a second transducer element mounted in predetermined relation to the base proximate the arm path;

(d) circuit means for producing an electrical trigger signal in response to the movement of the first transducer element to a predetermined spatial relation with the second transducer element; and (e) means for initiating the combustion in response to the trigger signal.

3. The apparatus of claim 2, wherein the rocker arm is pivotably mounted on an arm axis the arm path being arcuate.

4. The apparatus of claim 3, further comprising means for biasing the rocker arm against movement of the cam lobe, the movement of the first transducer element directly following the cam lobe.

5. The apparatus of claim 2, wherein the second transducer element is movably mounted to the base on a transducer platform for adjustment of ignition timing.

6. The apparatus of claim 5, wherein the transducer platform is pivotally movable about the arm axis.

7. The apparatus of claim 5, wherein the transducer platform is slidably mounted to the base.

8. An ignition apparatus for an internal combustion engine having a cam shaft lobe for actuating a push rod, but not having a distributor shaft rotatable for actuating breaker points or the like, the apparatus comprising:

(a) a base for mounting to the engine;

(b) a rocker arm movably mounted to the base for periodic actuation by the cam lobe and having a first transducer element fixably located thereon for movement in an arm path;

(c) a second transducer element movably mounted on a transducer element to the base proximate the arm path for adjustment of ignition timing;

(d) circuit means for producing an electrical trigger signal in response to the movement of the first transducer element to a predetermined spatial relation with the second transducer element;

(e) means for initiating the combustion in response to the trigger signal; and (f) an adjustment screw for threadingly engaging one of the base and the transducer platform, and an adjustment spring for biasing the transducer platform in opposition to the adjustment screw, whereby tightening and loosening of the adjustment screw produces bidirectional movement of the transducer platform relative to the base.

9. The apparatus of claim 8, further comprising clamp means for rigidly clamping the transducer platform against the base for selectively preventing the movement of the transducer platform.

10. An ignition apparatus for an internal combustion engine having a crankshaft-operated cam shaft lobe for actuating a push rod, but not having a distributor shaft rotatable for actuating breaker points or the like, the apparatus comprising:

(a) a base for mounting to the engine;

(b) a rocker arm movably mounted to the base for periodic actuation by the cam lobe and having a first transducer element fixably located thereon for movement in an arm path;

(c) a second transducer element mounted in predetermined relation to the base proximate the arm path, the second transducer element comprising a radiation detector;

(d) means for producing radiation from the first transducer element, the second transducer element being responsive to the radiation from the first transducer element;

(e) circuit means for producing an electrical trigger signal in response to the movement of the first transducer element to a predetermined spatial relation with the second transducer element; and (f) means for initiating the combustion in response to the trigger signal.

11. The apparatus of claim 10, wherein the first transducer element comprises a source of the radiation.

12. The apparatus of claim 2, wherein the first transducer element comprises a magnetic member for producing a magnetic field.

13. The apparatus of claim 12, wherein the second transducer element comprises a Hall-effect sensor.

14. The apparatus of claim 2, wherein the trigger signal is activated during a first direction of movement of the first transducer element relative to the second transducer element.

15. An ignition apparatus for an internal combustion engine having a cam shaft lobe for actuating a push rod, but not having a distributor shaft rotatable for actuating breaker points or the like, the apparatus comprising:

(a) a base for mounting to the engine;

(b) a rocker arm movably mounted to the base for periodic actuation by the cam lobe and having a first transducer element fixably located thereon for movement in an arm path;

(c) a second transducer element mounted in predetermined relation to the base proximate the arm path;

(d) circuit means for producing an electrical trigger signal in response to the movement of the first transducer element to a predetermined spatial relation with the second transducer element, the trigger signal being activated during a first direction of movement of the first transducer element relative to the second transducer element, the trigger signal being reset during an opposite second direction of movement of the first transducer element relative to the second transducer element; and (e) means for initiating the combustion in response to the trigger signal.

16. The apparatus of claim 15, wherein the trigger signal is reset only during the second direction of movement of the first transducer element.

17. An ignition apparatus for an internal combustion engine having a crankshaft-operated cam shaft lobe for actuating a push rod, but not having a distributor shaft rotatable for actuating breaker points or the like, the apparatus comprising:

(a) a base for mounting to the engine;

(b) a rocker arm movably mounted to the base for periodic actuation by the cam lobe and having a first transducer element fixably located thereon for movement in an arm path;

(c) a second transducer element mounted in predetermined relation to the base proximate the arm path, the second transducer element being fixedly mounted relative to a transducer platform;

(d) circuit means for producing an electrical trigger signal in response to the movement of the first transducer element to a predetermined spatial relation with the second transducer element, the circuit means comprising a solid-state switching device for activating an ignition coil in response to the second transducer element, the switching device being mounted to the transducer platform for dissipation of heat from the device to the platform; and (e) means for initiating the combustion in response to the trigger signal.

* * * * *